US006653269B2

(12) United States Patent
Housmekerides et al.

(10) Patent No.: US 6,653,269 B2
(45) Date of Patent: Nov. 25, 2003

(54) LAUNDRY COMPOSITIONS

(75) Inventors: Chris E. Housmekerides, Venice (IT); Daniele Fregonese, Venice (IT); Luca Zambelli, Venice (IT); Dora Zamuner, Venice (IT)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/310,506

(22) Filed: Dec. 5, 2002

(65) Prior Publication Data

US 2003/0109401 A1 Jun. 12, 2003

Related U.S. Application Data

(62) Division of application No. 09/745,383, filed on Dec. 21, 2000, now Pat. No. 6,579,838.

(30) Foreign Application Priority Data

Dec. 28, 1999 (EP) ..... 99125979

(51) Int. Cl.[7] ..... C11D 3/00; C11D 7/18

(52) U.S. Cl. ..... 510/309; 510/303; 510/349; 510/375

(58) Field of Search ..... 510/309, 303, 510/349, 360, 367, 370, 375, 376, 418, 441, 517, 518

(56) References Cited

U.S. PATENT DOCUMENTS

| | | | | | |
|---|---|---|---|---|---|
| 4,642,198 | A | | 2/1987 | Humphreys | |
| 5,460,743 | A | | 10/1995 | Delwel et al. | |
| 5,641,739 | A | | 6/1997 | Kott et al. | |
| 6,025,319 | A | * | 2/2000 | Surutzidis et al. | 510/441 |
| 6,221,826 | B1 | * | 4/2001 | Surutzidis et al. | 510/349 |
| 6,225,276 | B1 | * | 5/2001 | Gassemeier et al. | 510/376 |

FOREIGN PATENT DOCUMENTS

| | | | | |
|---|---|---|---|---|
| DE | 40 40 654 A1 | | 6/1992 | |
| DE | 299 03 534 U 1 | | 7/1999 | |
| DE | 198 55 346 A1 | | 6/2000 | |
| EP | 0 201 958 A1 | | 11/1986 | |
| EP | 0 292 314 | * | 11/1988 | B05D/1/22 |
| EP | 0 382 464 A2 | | 8/1990 | |
| EP | 0 435 379 A2 | | 7/1991 | |
| WO | WO 95/14077 | | 5/1995 | |

* cited by examiner

*Primary Examiner*—Yogendra N. Gupta
*Assistant Examiner*—John M. Petruncio
(74) *Attorney, Agent, or Firm*—Fish & Richardson P.C.

(57) ABSTRACT

A laundry composition, preferably to be used in addition to a laundry detergent, comprises an acidic peroxidic liquid, and particles suspended in the liquid. The particles comprise a protective coating around a core which includes at least one active ingredient selected from a chelating agent, a dye-transfer inhibitor, an anti-fading agent, an anti-bacterial agent, a fabric softener, a transition metal compound and an optical brightener. The particles are stable in the acidic peroxidic liquid but dissolve or disperse under alkaline washing conditions. Surprisingly incorporation of active ingredient(s) into particles appears to give better washing results than the dissolution of such active ingredients in such a liquid.

13 Claims, No Drawings

LAUNDRY COMPOSITIONS

This application is a division of 09/745,383 filed Dec. 21, 2000 now U.S. Pat. No. 6,579,838.

This invention relates to a laundry composition, in particular to a laundry composition having an acidic peroxidic liquid. The invention relates in particular to a laundry boost composition to be used in addition to the usual laundry detergent.

Acidic liquid bleach compositions are well known as specific purpose laundry products. Those products are usually added—in addition to the usual laundry detergent—to enhance the bleach activity. With the products presently available there are, however, some problems which have not been fully solved as yet, such as control of dry-transfer from colored to light fabrics, stain removing performance on specific soils such as make-up stains and proteinic stains, reduction of whiteness of white fabrics following multiple washings, and the use in such compositions of components which may react prematurely with each other. It is an object of the present invention to solve or ameliorate one or more of those problems.

This invention is based on the surprising finding that incorporating specific ingredients, including ingredients already known as showing activity in an acidic liquid bleach composition, into separate particles held in stable suspension in the composition (preferably homogeneously distributed throughout the composition), results in performance improvements compared with similar compositions with the same active ingredients, but not concentrated in particles.

In accordance with a first aspect of the invention there is provided a laundry composition comprising:

a) an acidic liquid containing hydrogen peroxide, and b) particles suspended in the liquid wherein the particles comprise a protective coating around a core which includes at least one active ingredient selected from a chelating agent, a dye-transfer inhibitor, an anti-fading agent, an anti-bacterial agent, a fabric softener, a transition metal compound and an optical brightener and wherein the particles are stable in the acidic liquid but dissolve or disperse under alkaline washing conditions.

The term "liquid" as used herein includes a flowable gel.

One preferred active ingredient within the particles is a chelating agent.

A preferred class of chelating agents within the particles is the water-soluble polyphosphonates, especially diphosphonates including sodium, potassium, and lithium salts of ethane-1-hydroxy-1,1-diphosphonic acid; sodium, potassium and lithium salts of methylenediphosphonic acid; sodium, potassium salts of hydroxyethylidene diphosphonic acids, and the like. Especially preferred is sodium hydroxyethylidene diphosphonate (Na HEDP).

Another preferred class of chelating agents is the dialkylene polyacetic acids or salts thereof, notably diethylene pentacetic acid or a salt thereof, especially the pentasodium salt. An example of the acid is the product DETAREX from Dow. An example of the pentasodium salt is the product VERSENEX 80E from Dow.

Another preferred class of chelating agents is the acrylic acid/acrylate polymer class, for example polyacrylic acid or a copolymer which includes acrylic acid as a monomer unit. One example is the product ACRILAM C20 available from Lamberti, Italy.

Another possible class of chelating, agents, especially in the acidic liquid, is the alkali metal salts of aliphatic hydroxydi- or hydroxytri-carboxylic acids. Suitable compounds include the alkali metal salts of malic, tartaric, isocitric, trihydroxyglutaric and, especially, citric acid. Sodium salts are generally preferred. An especially preferred compound of this class is sodium citrate.

When one or more chelating agent is present in the particles the content thereof is preferably in the range 1–99%, preferably 5–50%, most preferably 10–25% (weight of chelating agent(s) in total, on total weight of particles).

One preferred active ingredient within the particles is a dye-transfer inhibitor.

Preferred dye-transfer inhibitors (sometimes called dye anti-redisposition agents or soil suspending agents) within the particles include polyvinylalcohol, fatty amides, sodium carboxylmethyl cellulose, hydroxypropyl methyl cellulose, polyvinylpyrolidone, polyvinylimidazole, polyvinyloxazolidone, polyamine N-oxide polyers and copolymers or N-vinylpyrolidone and N-vinylimidazole. Most preferred is poly(4-vinyl pyridine N-oxide)—known as PVNO—preferably having a molecular weight in the range 3,000–30,000, most preferably 5,000–20,000.

When one or more dye-transfer inhibitor is present in the particles the content thereof is preferably in the range 1–80%, preferably 5–50%, most preferably 10–25% (weight of dye transfer inhibitor(s) in total, on total weight of particles).

One preferred active ingredient within the particles is a fabric softening agent, for example of the well-known cationic softener type, as described in GB 2197666A. In respect of the cationic materials the content of GB 2197666A is incorporated herein by reference.

When one or more fabric softening agent is present in the particles the content thereof is preferably in the range 1–60%. preferably 5–30%. most preferably 10–25% (weight of fabric softening agent(s) in total. on total weight of particles).

One preferred active ingredient within the particles is an optical brightener. Suitable optical brighteners include stilbene derivatives such as 4,4'-bis(triazine-2-ylaminio) stilbene—2.2'-disulphonic acid, mono(azol-2-yl)stilbene and bis(azol-2-yl)stilbene: styryl derivatives of benzene and biphenyl such as 1,4-bis(styryl)benzene, 4,4'-bis(styryl) benzene 4,4'-bis-(styryl)biphenyl, 4,4'-bis(sulphostryryl) biphenyl sodium salt; pyrazolines such as 1,3-diphenyl-2-pyrazoline; bis(benzene-2-yl) derivatives, bis(benzoxazol-2-yl) derivatives and bis(benzimidazol-2-yl) derivatives; 2-(benzofuran-2-yl)benzimidazole; coumarins such as 4-methyl-7-hydroxy-coumarin or 4-methyl-7-diethylaminocoumarin; carbostyrils; naphthalimides; dibenzothiophene-5,5-dioxide; pyrene; or pyridotriazole derivatives.

When one or more optical brightener is present in the particles the content thereof is preferably in the range 1–40%, preferably 5–30%, most preferably 10–25% (weight of optical brightener(s) in total, on total weight of particles).

Transition metal compounds as active ingredients within the particles may offer several benefits. Of greatest interest are photocatalytic transition metal complexes and transition metal oxides, in all cases selected to accelerate the decomposition of hydrogen peroxide once they are released into the wash liquor, in which they are dispersed. That action may be accelerated by a sensitiser; in the case of titanium dioxide the ruthenium polypyridyl derivatives taught in the literature (for example in J. Am. Chem. Soc. 2000, 122. pp. 2840–2849) are suggested. Certain transition metal compounds may also offer colorant or whitening benefit to improve the aesthetics of the composition. Certain transition metal compounds are relatively dense materials within the particles and in admixture with less dense materials may be used to adjust the density of the particles, to be the same as or close to the density of the liquid. Preferred transition metal compounds are inorganic compounds, notably zinc oxide and, most preferably. titanium dioxide.

One preferred active ingredient within the particles is an anti-bacterial agent. Suitable anti-bacterial agents include quaternary ammonium compounds, preferably of formula $(CH_3)_2R_2R_3N^+—X^-$ where $R_2$ is selected from $C_{12-16}$ alkyl, ($C_{8-18}$ alkyl) alkyl)phenolethoxy, and $R_2$ is benzyl or $R_2$ and $R_3$ are independently selected from $C_{8-12}$ alkyl; and X is selected from halide, preferably bromine, iodine or, especially, chlorine, and methosulfate.

When one or more anti-bacterial agent is present in the particles the content thereof is preferably in the range 1–60%, preferably 5–30%, most preferably 10–25% (weight of anti-bacterial agent(s) in total, on total weight of particles).

One preferred active ingredient within the particles is an anti-fading agent. Suitable anti-fading agents (sometimes called dye-fixatives) are described in WO 98/29529 and the definitions therein are incorporated in this specification by reference.

When one or more anti-fading agent is present in the particles the content thereof is preferably in the range 1–60%, preferably 5–30%, most preferably 10–25% (weight of anti-fading agent(s) in total, on total weight of particles).

While the particles may comprise all seven classes of active ingredients mentioned herein preferably they comprise not more than four. More preferably they comprise not more than three. Most preferably they comprise two or, especially, one.

Especially preferred active ingredients within the particles are dye-transfer inhibitors, and, especially, chelating agents.

Preferably the particles do not contain any bleaching compound or bleach precursor, whether based on active chlorine or peroxygen chemistry.

Preferably the particles do not contain any organic bleach activator, such as TAED, NOBS or BOBS.

Preferably the particles do not contain any enzyme component(s).

Preferably the peroxygen compound in the liquid is present in an amount in the range 2–15%, preferably 3–10%, most preferably 4–8%, on weight of the liquid (that is, without particles).

The active ingredient(s), if solid or highly viscous, can be encapsulated by a pH sensitive coating directly after forming the cores of the particles. The cores are preferably formed by the well known process of spray chilling. Of course, many manufacturing methods are available. If the active ingredient(s) is liquid, a porous carrier material may be used to absorb the active ingredient and to encapsulate the carrier material and active ingredient(s), by means of the pH sensitive coating. Any suitable carrier known from the prior art could be used, although there may be some restrictions in order to avoid residues of the carrier material after the washing cycle.

Preferably solid active ingredient(s) are selected.

In a specific embodiment of the present invention the core of the particles may therefore include a solid carrier material. The carrier material, when used, may be inert in the wash liquor after dissolution or dispersion or may have some effect on the washing operation. However in the latter case it is preferably a minor effect, not itself being an "active ingredient" delivering a specific benefit in the washing operation or acting in an non-stoichiometric way, for example in the manner of a catalyst or promoter. Its primary function is to facilitate manufacture and to dissolve or disperse readily in an alkaline wash liquor.

A suitable carrier material is a waxy or pasty or plastic material, into which the active ingredient(s) may be stably embedded. A preferred carrier material is a higher fatty acid and/or salt thereof, for example a $C_{14-22}$ fatty acid or salt thereof, especially a $C_{6-20}$ fatty acid or salt thereof. Saturated fatty acids and/or salts thereof are preferred. The fatty acids are favoured, over the salts. Most preferred is stearic acid, which has an excellent blend of properties for this carrier function.

When a carrier material is used it preferably constitutes 5–98% of the weight of the particles (including the coating), preferably 20–75%., most preferably 40–70%.

Preferably, the coating is insoluble in the acidic peroxidic liquid, but becomes rapidly soluble upon raising the pH of the environment above about 7.

Specifically, the coating preferably comprises a pH sensitive material able to withstand substantial solubilizing in said formulation up to a pH or about 6.5, but becomes completely soluble in an environment at a pH above about 7.

There are many coating materials suitable for this purpose. As noted in WO 87/07292, so-called "enteric coatings" as used in the pharmaceutical field. These are required to be stable under acid conditions and dissolve under alkaline conditions. According to WO 87/07292 they may also be used to coat particles used in the laundry field, where the particles are to be provided in an acidic peroxidic liquid. As typical examples of suitable coating agents of this type WO 87/07292 lists the following:

Cellulose acetate phthalate (Cellacephate®, CAP), vinyl acetate crotonic acid copolymer (Luviset®). methacrylic acid, (meth)acrylic acid ester copolymer (Eudragit(®) and hydroxypropyl methylcellulose phthalate.

Of these possible materials Eudragit was used as coating material in the examples of WO 87/07292. Likewise, we favour, for convenience, use of a copolymer of methacrylic acid and methacrylate and/or of methacrylic acid and ethylacrylate, although many other materials, including those listed above, may be used and have similar properties.

Similar materials are listed in U.S. Pat. No. 4,973,422.

As is conventional, a plasticizer may be used in the coating material. One suitable plasticizer is diisopropyl adipate. When a plasticiser is used it preferably comprises 2–20%, preferably 5–15%, of the total weight of the coating.

The manufacture of coated particles suitable for use in the invention is well known. A good overview of the different methods available is given in EP 292314, the contents of which are incorporated herein by reference. Briefly, they include fluidized bed technology: the Wurster procedure. involving a vertically disposed coating tower with particles suspended in an upwardly directed air/coating material flow; and the Top Spray Coating technique involving spraying the coating suspension onto fluidized particles subject to an upward air flow. In relation to coating the particles manufacturers' recommendations may be followed. For example Röhm leaflet Info 2.4/E describes and recommends the Top Spray Coating technique, and gives information about the processing parameters.

Suitably the coating constitutes 1–60%, preferably 5–50%, most preferably 7–40%, especially 8–20%, of the total weight of the particles.

Preferably the particles are of mean size (diameter) 0.1 mm to 3 mm, more preferably 0.5 mm to 2 mm, most preferably 1 mm to 1.5 mm.

Preferably the particles have a density which is within 0.2 g/cm$^3$ of the density of the liquid, more preferably within 0.1 g/cm$^3$. Typically the liquid will have a density of about 1 g/cm$^3$. Most preferably the particles are manufactured with a density in the range 0.95–1.05 g/cm$^3$.

Preferably the liquid contains a compound which promotes inter-molecular cohesion with the coating, as an aid to hold the particles in suspension in the liquid. When the coating comprises an acrylic and/or acrylate polymer a small amount of a polyacrylic/acrylate compound in the liquid may achieve this (for example 0.05–0.4%, on total weight of the liquid, without particles).

The liquid may usefully contain a surfactant, preferably a relatively small amount when it is intended for use as a laundry boost composition; for example 4–15%, preferably 5–10%, on total weight of liquid, without particles. Suitably a surfactant when present is a non-ionic surfactant, suitably a $C_{6-18}$ (preferably $C_{12-15}$) primary or secondary linear or branched alcohol condensed with an alkylene oxide, preferably with an average 3–8 moles of the alkylene oxide per mole of fatty alcohol. The preferred alkylene oxide is ethylene oxide.

Preferably the pH of the liquid is in the range pH 2–6, preferably pH 3–5.5.

Preferably the viscosity of the composition (liquid and particles together) is in the range 100–10,000 cps, preferably 200–3,000 cps, most preferably 500–1,500 cps (as measured by a Brookfield Viscosimeter, Spindle no. 3, spindle rate No. 12, at 20° C.). If wished a viscosity modifying agent can be included in the liquid. It has been found that xanthan gum is a good material to include as in our tests it has provided an unexpected beneficial effect on the physical stability of the particle/liquid composition. When xanthan gum is included an amount in the range 0.01–0.2%, on total weight of the composition, may be used.

Preferably the liquid includes a chelating agent. When one or more chelating agent is present in the liquid the content thereof is preferably in the range 0.01–1%, more preferably 0.02–0.5%, most preferably 0.05–0.3% (weight of chelating agent(s) in the liquid in total, on total weight of liquid, absent particles).

Suitable as chelating agent in the liquid are any of the chelating agents described above as being suitable chelating agents for incorporation into the particles.

Preferably the liquid contains a colorant. Preferably the particles are white. Alternatively they could contain, in the coating and/or the core. a non-white colorant.

Suitably the particles constitute 0.05–10%, preferably 0.1–5%, more preferably 0.2–2% of the total weight of the composition (liquid and particles).

In accordance with a second aspect of the present invention there is provided the use of particles in an acidic peroxidic liquid composition, comprising at least one active ingredient which is essentially not released in an acidic liquid peroxidic environment, and which will be released in an alkaline environment. to improve the overall performance of acidic liquid peroxidic bleach composition.

The invention relates also therefore to a method of laundering fabrics, using a laundry detergent and, in addition, a composition of the invention as described herein.

As described in more detail later on, compositions according to the present invention appear to show distinct and surprising performance advantages compared to similar compositions with the same active ingredients, but not contained in particles. Although we do not want to be bound by any theory, it is hypothesized that the encapsulated form of the particles causes a certain delay in the release of the active ingredient(s) in the cashing liquor, which delay is connected (in some manner we do not yet understand) to the performance improvements. Furthermore the use of particles permits the provision in a single composition of components which are mutually incompatible, for example hydrogen peroxide and a transition metal compound.

The invention will now be described further, by way of example, with reference to the following non-limiting embodiments.

In these examples the following materials are referred to:

Na HEDP—sodium hydroxyethylidene diphosphonate, available under the trade name DEQUEST 2010, from Dequest.

EUDRAGIT S100—an acrylic copolymer offered by Röhm GmbH for coating laundry and pharmaceutical particles. based on acrylate/methyl acrylate monomers.

LIALET 125/5—a non-ionic surfactant, being an ethoxylated $C_{12-15}$ fatty alcohol with 5 moles of ethylene oxide per mole of fatty alcohol, from Condea.

POLYGEL DA—a high molecular weight (mw>1,000,000) polyacrylic acid (chelating agent), from 3V Sigma.

VERSENEX 80E—pentasodium salt of diethylenetriamine pentacetic acid (chelating agent), from Dow DETAREX—diethylenetriamine pentacetic acid (chelating agent), from Dow ACRILAM C20—a low molecular weight chelating copolymer based on acrylic acid monomers, from Lamberti.

OXY RITE—a viscosity stabiliser. from Goodrich.

DEQUEST 2010, EUDRAGIT S100. LIALET, POLYGEL DA, VERSENEX 80E, DETAREX, ACRILAM C20 and OXY RITE are believed to be trade marks.

EXAMPLE SET A

Performance Tests—Phosphonate-containing Particles

Two different grades of particles were prepared with the following constituents (expressed as parts by weight):

| Composition | P1 % | P2 % |
|---|---|---|
| Stearic acid (carrier) | 60 | 50 |
| Na HEDP (chelating agent) | 20 | 15 |
| EUDRAGIT S100 | 15 | 25 |
| Diisopropyl adipate (plasticizer for coating) | 5 | 10 |

The particle cores were made by melting the stearic acid mixed with the Na HEDP (in powder form), and then spray chilling. The resultant solid cores were then coated using commercially available Glatt technology. Thus, the plasticizer and the acrylic precursors were dissolved in 60% acetone/40% isopropanol (v:v). The concentration of the materials in the solvent was 10% by weight. The cores were coated in a vertical fluid bed. the acrylic material being polymerised in situ. The resulting particles, having a mean size (diameter) of about 1.5 mm and a density of about 1 g/cm$^3$, were incorporated in two acidic liquid bleach formulations E1 (containing P1 particles) and E2 (containing P2 particles), set out below. For comparison, a composition with the same ingredients but without particles was prepared and designated as V1. The pH was adjusted to 4.2 in each case using sodium hydroxide.

| Composition | E1 % | E2 % | V1 % |
|---|---|---|---|
| Hydrogen peroxide | 6.50 | 6.50 | 6.50 |
| LIALET 125/5 | 7.00 | 7.00 | 7.00 |
| Na HEDP | 0.12 | 0.12 | 0.7 |
| Particles | 4.37 | 5.00 | 0 |
| POLYGEL DA | 0.20 | 0.20 | 0.20 |
| Perfume | 0.20 | 0.20 | 0.20 |
| Pigment | 0.001 | 0.001 | 0 |
| Deionised water | to 100 | to 100 | To 100 |
| Viscosity (cps, at 20° C.) | 500–1000 | 500–1000 | 1000–1500 |
| PH | 4.2 | 4.2 | 4.2 |

Although the particles in E1 and E2 contain HEDP in the form of its tetrasodium salt, to enable comparison with the V1 formulation the amounts are expressed above in terms of the equivalent free acid.

Performance Tests

1. Dye Transfer Behaviour

30×60 cm test pieces of white and colored fabrics ere prepared by sewing one 30×30 cm piece of colored fabric in one side to one 30×30 cm piece of white fabric, edge to edge.

Washing loads consisting of 3.5 kg white fabrics and one test piece as described above were washed ten times in a Balay T8223 washing machine selecting washing program No. 1 using 100 ml of one of the bleach formulations E1, E2 and V1, dosed alone (without detergent) in a shuttle placed in the drum of the washing machine.

At the end of the ten washes at 40° C. the reflectance of the white part of the test piece was evaluated both instrumentally (Reflectance dE measured in an UltraScan XE Spectrophotometer from Hunterlab) and by panellists. In the latter assessments the reflectance was compared visually with the reflectance of non-washed test fabrics and the difference was expressed by the panellists according to the following scale:

1. Unchanged
2. Very small difference
3. Small difference
4. Moderate difference
5. Strong difference For the instrumental assessments a zero value would indicate no difference in whiteness, and therefore no observed dye-transfer to the white part.

The results are shown in the table below.

| | Evaluation | Composition | | | |
|---|---|---|---|---|---|
| Color/fabric | type | E1 | E2 | V1 | Delta |
| Sirius Blue CLB | Visual | 2.0 | | 3.0 | +1.0 |
| on cotton | Instrumental | 6.0 | | 9.6 | +3.6 |
| Sirius Blue CLB | Visual | 2.0 | | 3.0 | +1.0 |
| on viscose | Instrumental | 7.4 | | 10.7 | +3.3 |
| Sirius Red SLR | Visual | | 2.5 | 3.0 | +0.5 |
| on cotton | Instrumental | | 5.4 | 11.5 | +1.8 |
| Sirius Red SLR | Visual | | 2.0 | 3.0 | +1.0 |
| on viscose | Instrumental | | 5.4 | 5.8 | +0.4 |
| Sirius Yellow | Visual | | 2.5 | 3.5 | +1.0 |
| SLG on cotton | Instrumental | | 11.4 | 14.0 | +2.6 |
| Sirius Yellow on | Visual | | 2.0 | 3.0 | +1.0 |
| viscose | Instrumental | | 8.2 | 9.7 | +1.5 |

From these results, it will be seen that the compositions E1 and E2 of the invention showed advantage over the control composition V1.

The data presented in the table show that there is less dye-transfer between colored fabrics and white fabrics when the liquid composition has at least part of its phosphonate in an encapsulated form compared with a comparison composition having all of its active ingredients dissolved in the liquid phase.

2. Stain Removal Performance

In a further test the two formulations according to the present invention (E1 and E2) as well as the comparative formulation (V1) were tested for stain removal performance on cosmetic make-up soils.

+3 points of difference in reflectance measured instrumentally (as described hereinabove) can be found between washes effected with formulations E1 and E2 (according to the present invention) on the one hand and comparative formulation V1 on the other hand. +2 points of difference in reflectance are even visible to the naked eye.

3. Reduction of Whiteness Level

In a further test, the reduction in whiteness level of white fabrics following multiple washings was tested.

+6.3 points of difference in reflectance measured instrumentally (as described hereinabove) was found after six washing cycles performed on white cotton table cloths when measuring the reflectance of fabric washed with formulations E1 and E2 (according to the present invention) on the one hand and with comparative formulation V1 on the other hand.

EXAMPLE SET B

Alternative Compositions

Alternative particles were made, to those used for Example Set A. The alternative particles (P3 below) had a core of stearic acid and titania, and a coating (like that of the particles of Example Set A) of EUDRAGIT S100 copolymer and diisopropyl adipate, such that the final particles had the following proportions by weight:

Particles P3

| | |
|---|---|
| Stearic acid | 81% |
| Titania powder (rutile, sub-micron) | 9% |
| EUDRAGIT copolymer | 9% |
| Diisopropyl adipate | 1% |

These particles were made in the manner described above for the particles used in Example Set A.

The titania performs three functions. Firstly once the particles have dissolved it acts as an accelerator for the hydrogen peroxide reaction, during washing. Secondly it acts as a whitener for the particles and thus improves the aesthetics of the composition (e.g. bright white speckles in a colored liquid gel). Thirdly it helps to give the particles the correct density to stay in stable suspension (stearic acid being a solid of considerably lower relative density—0.839—than water).

These particles were incorporated into the following liquid compositions (E3–E6), and in each case gave a stable composition with good washing properties.

| Ingredients | % |
|---|---|
| Composition E3 | |
| Hydrogen peroxide | 6.5% |
| Na HEDP | 0.2% |
| LIALET 125/5 | 7.0% |
| POLYGEL DA | 0.2% |
| Blue pigment | 0.001% |
| Phthalocyanine green dye | 0.0002% |
| Perfume | 0.27% |
| Particles | 0.2% |
| Sodium hydroxide | to pH 4.3 |
| Deionised water | to 100% |
| Composition E4 | |
| Hydrogen peroxide | 6.5% |
| LIALET 125/5 | 7.0% |
| VERSENEX 80E | 0.3% |
| POLYGEL DA | 0.3% |
| Blue dye | 0.0005% |
| Perfume | 0.27% |
| Particles | 0.2% |
| Sodium hydroxide | to pH 4.3 |
| Deionised water | to 100% |
| Composition E5 | |
| Hydrogen peroxide | 6.5% |
| LIALET 125/5 | 7.0% |
| DETAREX | 0.12% |
| POLYGEL DA | 0.3% |
| Blue dye | 0.0005% |
| Perfume | 0.27% |
| Particles | 0.2% |
| Sodium hydroxide | to pH 4.3 |
| Deionised water | to 100% |
| Composition E6 | |
| Hydrogen peroxide | 6.5% |
| LIALET 125/5 | 7.0% |
| ACRILAM C20 | 0.2% |
| POLYGEL DA | 0.20% |
| OXY RITE | 0.15% |
| Blue dye | 0.0005% |
| Perfume | 0.27% |
| Particles | 0.2% |
| Sodium hydroxide | to pH 4.3 |
| Deionised water | to 100% |

EXAMPLE SET C

Particles Containing Dye-transfer Inhibitor

The E3 composition mentioned above was formulated, but with different particles, to make compositions E7–E10. The particles contained 9% EUDRAGIT copolymer, 1% diisopropyl adipate plasticiser, X% PVNO and (90-X)% stearic acid. X was 10, 20, 30 and 40. The PVNO as commercially supplied was an aqueous composition. Water was evaporated from this under gentle warming to leave a pasty/oily concentrate able to be mixed with stearic acid for the spray chilling process described in Example Set A.

The first performance test described in Example Set A was carried out, with the differences that a standard anionic-based laundry detergent (trade name LANZA LAVATRICE) was used in its recommended amount, and each test piece was washed three times. At the end of the three washes the reflectance of the white part of the test piece was evaluated instrumentally using the UltraScan XE machine described above. The dye transfer behaviour was thus determined. In addition the colored part of the test pieces were evaluated by the same machine, to assess the color-fade performance. (Four replicates were carried out for each composition and the results were averaged.

The results are set out in the table below.

| % PVNO in particles | Reflectance value -white part | Reflectance value -colored part |
|---|---|---|
| 0 (comparison) | 4.7 | 4.2 |
| 10 (composition E7) | 3.4 | 4.3 |
| 20 (composition E8) | 2.2 | 4.3 |
| 30 (composition E9) | 1.1 | 4.4 |
| 40 (composition E10) | 0.8 | 4.5 |

The results show excellent dye-transfer resistance, particularly from the compositions with higher amounts of PVNO in the particles, and excellent anti-fade performance from all the compositions.

EXAMPLE SET D

Stability Testing

The composition E11 set out below was prepared by mixing. The particles are the same as those described in Example Set B.

| Composition E11 | |
|---|---|
| Ingredients | % |
| Hydrogen peroxide | 6.5% |
| LIALET 125/5 | 7.0% |
| ACRILAM C20 | 0.3% |
| POLYGEL DA | 0.2% |
| Xanthan gum (stabiliser) | 0.05% |
| Blue pigment | 0.001% |
| Phthalocyanine green dye | 0.0002% |
| Perfume | 0.27% |
| Particles (see above) | 0.2% |
| Sodium hydroxide | To pH 4.3 |
| Deionised water | To 100% |

The table below records the viscosity and particle suspension of composition E11 over a period of three months at room temperature, at an elevated temperature and at a depressed temperature. In all cases good results were found.

| | | | |
|---|---|---|---|
| Viscosity: after 24 h at 20° C. (cps) | | 1400 | |
| After 6 days | 2° C. | 1180 | All particles remain in homogenous suspension |
| | 20° C. | 1340 | |
| | 40° C. | 1540 | |
| After 1 month | 2° C. | 1120 | All particles remain in homogenous suspension |
| | 20° C. | 1340 | |
| | 40° C. | 1650 | |
| After 2.5 months | 2° C. | 1000 | All particles remain in homogenous suspension |
| | 20° C. | 1200 | |
| | 40° C. | 1100 | |
| After 3 months | 2° C. | 1130 | All particles remain in homogenous suspension |
| | 20° C. | 1380 | |
| | 40° C. | 900 | |

What is claimed is:

1. A laundry composition comprising:

a) an acidic liquid containing hydrogen peroxide, and b) particles suspended in the liquid, wherein the particles comprise a protective coating around a core which includes at least one active ingredient selected from a chelating agent, an anti-fading agent, an anti-bacterial agent, a fabric softener, a transition metal compound and an optical brightener, and wherein the particles are stable in the acidic liquid but dissolve or disperse under alkaline washing conditions.

2. A composition according to claim 1, wherein the core comprises a chelating agent.

3. A composition according to claim 2, wherein the chelating agent comprises a compound selected from the group consisting of phosphonates, polyacetic derivatives and polyacrylic derivatives.

4. A composition according to claim 2 wherein the core additionally comprises one or more compounds selected from an anti-fading agent, an anti-bacterial agent, a fabric softener, a transition metal compound and an optical brightener.

5. A composition according to claim 1, wherein the mean size of the particles is from 0.5 mm to 3 mm.

6. A composition according to claim 1, wherein the particles have a density which is within 0.2 g/cm$^3$ of the density of the liquid.

7. A composition according to claim 1, wherein the liquid additionally contains a nonionic surfactant.

8. A composition according to claim 1, wherein the liquid additionally contains a chelating agent.

9. In a method of laundering fabrics using a laundry detergent, the improvement which comprises adding to the wash liquor a composition comprising a) an acidic liquid containing hydrogen peroxide, and b) particles suspended in the liquid, wherein the particles comprise a protective coating around a core which includes at least one active ingredient selected from a chelating agent, an anti-fading agent, an anti-bacterial agent, a fabric softener, a transition metal compound and an optical brightener, and wherein the particles are stable in the acidic liquid but dissolve or disperse under alkaline washing conditions.

10. A method according to claim 9 wherein the core comprises a chelating agent.

11. A method according to claim 10 wherein the core additionally comprises one or more compounds selected from an anti-fading agent, an anti-bacterial agent, a fabric softener, a transition metal compound and an optical brightener.

12. A method according to claim 9 wherein the liquid additionally contains a non-ionic surfactant.

13. A method according to claim 9 wherein the liquid additionally contains a chelating agent.

* * * * *